US005819974A

United States Patent [19]

Caldwell

[11] Patent Number: 5,819,974

[45] Date of Patent: Oct. 13, 1998

[54] OPEN-TOP BIN AND COVER

[76] Inventor: Gregory D. Caldwell, 3620 Lawson Rd., Glenview, Ill. 60025

[21] Appl. No.: 662,931

[22] Filed: Jun. 12, 1996

Related U.S. Application Data

[63] Continuation of Ser. No. 357,372, Dec. 16, 1994, abandoned.

[51] Int. Cl.[6] ..... B65D 45/16

[52] U.S. Cl. ..... 220/326; 217/124; 220/200; 220/315; 220/657

[58] Field of Search ..... 43/55; 296/50, 296/100, 136; 210/464, 474; 190/25–27, 119; 52/12; 217/124; 220/220, 200, 326, 315, 340, 657, 693, 692, 4.21, 4.24, 622

[56] References Cited

U.S. PATENT DOCUMENTS

| | | | |
|---|---|---|---|
| Re. 27,430 | 7/1972 | Wimmer | 200/657 X |
| 80,472 | 7/1868 | Gibson | 215/287 |
| 236,812 | 1/1881 | Higgins | 217/124 |
| 604,040 | 5/1898 | Gribben | 215/291 |
| 668,691 | 2/1901 | Rudd | 251/287 |
| 716,730 | 12/1902 | Marshall | 215/287 |
| 1,054,230 | 2/1913 | Meyer | 215/287 |
| 1,062,532 | 5/1913 | Blair | 220/319 |
| 1,088,133 | 2/1914 | Eichhorn | 215/287 |
| 1,110,042 | 9/1914 | Clark | 217/124 |
| 1,604,855 | 10/1926 | Skitt | 220/692 |
| 2,146,190 | 2/1939 | Luke | 220/326 R |
| 2,175,138 | 10/1939 | Westlake, Jr. | 52/12 |
| 2,208,463 | 7/1940 | Lloyd | 215/287 |
| 2,384,310 | 9/1945 | Judd | 215/287 |
| 2,465,621 | 3/1949 | Wheeler | 296/100 |
| 2,493,086 | 1/1950 | Reifsnyder | 220/780 X |
| 2,543,300 | 2/1951 | Ptak | 217/124 |
| 2,847,794 | 8/1958 | Loud et al. | 43/55 |
| 2,986,244 | 5/1961 | Hutchison | 220/693 |
| 3,067,039 | 12/1962 | Crane | 217/124 |
| 3,073,479 | 1/1963 | Broverman et al. | 220/326 X |
| 3,311,257 | 3/1967 | Puente | 220/657 X |
| 3,363,924 | 1/1968 | Remig | 220/323 X |
| 3,393,835 | 7/1968 | Kantor et al. | 296/100 X |
| 3,481,371 | 12/1969 | Row | 296/100 |
| 3,521,927 | 7/1970 | Barry | 296/100 |
| 3,614,154 | 10/1971 | Evans | 269/100 |
| 3,940,008 | 2/1976 | Flanders | 220/326 X |
| 4,172,614 | 10/1979 | Guido, Jr. | 296/100 |
| 4,373,642 | 2/1983 | Wolters et al. | 220/657 X |
| 4,523,692 | 6/1985 | Lemkin | 220/210 X |
| 4,556,150 | 12/1985 | Ikumi | 220/326 X |
| 4,632,272 | 12/1986 | Berenfield et al. | 220/780 X |
| 4,678,096 | 7/1987 | LaBarge et al. | 220/273 |
| 4,763,944 | 8/1988 | Fry et al. | 296/50 |
| 4,841,886 | 6/1989 | Rees | 52/12 |
| 4,888,920 | 12/1989 | Maralic | 52/12 |
| 5,028,740 | 7/1991 | Tomiya | 220/693 X |
| 5,110,178 | 5/1992 | Love | 296/218 |
| 5,137,324 | 8/1992 | Hershberger | 296/100 |
| 5,165,750 | 11/1992 | Pirhonen | 296/100 |
| 5,179,991 | 1/1993 | Haddad, Jr. | 296/100 X |
| 5,393,117 | 2/1995 | Beale | 296/100 |

FOREIGN PATENT DOCUMENTS

| | | | |
|---|---|---|---|
| 337682 | 3/1936 | Italy | 215/291 |

*Primary Examiner*—Allan N. Shoap
*Assistant Examiner*—Robin A. Hylton
*Attorney, Agent, or Firm*—Thomas C. McDonough

[57] ABSTRACT

A recycle bin having a bottom and a continuous side wall extending upwardly therefrom to form a receptacle having an opening opposite the bottom. A lip extends around the upper perimeter of the side wall proximate to the opening. A generally flexible top cover, sized to at least overlay the opening, is attached to the lip at a first location. A strap, having a first end secured to the top cover and a second end carrying a fastener adapted to releasably mate with the lip at a second location, is provided for releasably securing the top cover over the opening.

13 Claims, 2 Drawing Sheets

OPEN-TOP BIN AND COVER

This application is continuation, of application Ser. No. 08/357,372, filed 12/16/94, now abandoned.

BACKGROUND OF THE INVENTION

Discarded items of paper, plastics, and metals, including steel and aluminum and other materials that can be broken down to make new items of the same or related materials, are now commonly being sought and purchased by manufactures or primary users of such materials, in a popular effort to reduce the depletion of natural resources otherwise needed to formulate such materials originally. To support and even promote this demand, many local communities have hired waste management companies to pick up such items in salvage trucks directly from the discarding residence or business, typically at the street edge or curb.

As part of many such programs, the communities/salvage companies provide the item-discarding customers with special reusable durable containers to hold the items. One form of such a container is an open-top plastic bin, light in weight to be picked up and carried by the customer. The use of such bins could even be mandatory, whereby the salvage company would only pick-up the items contained in such bins.

Even though the pick-up day would be known, the exact time would not. Thus, the loaded bin might commonly be put out long before pick up, and remain there unattended until emptied. The exclusive use of only authorized bins and the limited pick up schedule mean many loaded or even overloaded bins, which when subjected to normal winds, could allow the lighter or less dense items (paper boxes or newpapers, plastic milk bottles, aluminum cans, or the like) to be blown out of the bin and about the area. This littering can be counter-productive to the popularity in any neighboor of these recycle programs.

SUMMARY OF THE INVENTION

This invention relates to and a basic object of this invention is to provide a cover for use with existing open top recycle bins, to overlie the open bin top and effectively hold items contained in the bin, even against forces including the wind that otherwise might remove one or more of the items from the bin.

A detailed feature of this invention includes a cover that is fixed in size and is generally larger than the open bin top, but that is flexible to allow it to be bowed up from the tops of opposed bin sidewalls for overlying items protruding above or beyond the bin top for retaining such items in the bin, thereby effectively increasing the holding capacity of the bin. The cover can be formed of a durable plastic, such as a polyethlene, as a flexible but dimensionally fixed open mesh screen having narrow cross webs defining openings generally smaller than possibly ¼–5 inches across. This allows the cover to overlie and contain even small items in the bin while yet having the contained items visible through the cover.

Yet others features of this invention include means for fixedly securing one side edge of the cover to one bin sidewall, even in-the-field by the customer for making the invention suitable as an add-on accessory for the bin, and further for quickly and easily securing or releasing the opposite side edge of the cover onto and from the opposite bin sidewall.

BRIEF DESCRIPTION OF THE DRAWINGS

These and other objects, features or advantages of the invention will be more fully understood and appreciated after consideration of the following complete description of the invention, which includes as a part thereof the accompanying drawings, wherein.

DETAILED DESCRIPTION OF A PREFERRED EMBODIMENT OF THE INVENTION

Figure 1:
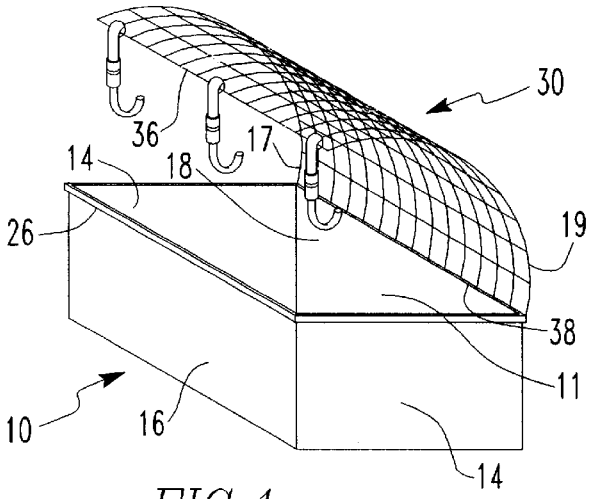
FIG. 1 is a perspective view of a typical recycle bin for which this invention forms an improvement, with a preferred embodiment of a cover shown thereon and opened.
Figure 2:
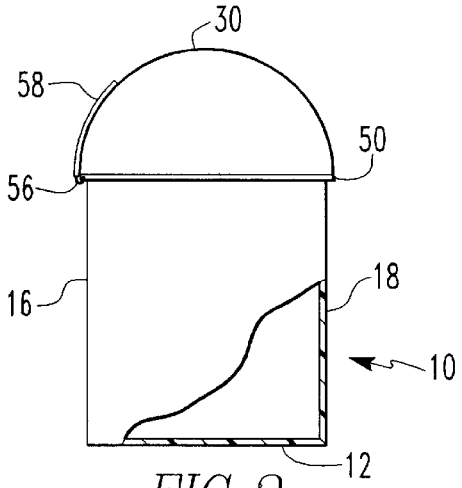
FIG. 2 is an end elevational view of the bin and cover of FIG. 1, except shown partly broken away and in section and with the bin overloaded and the cover closed.
Figure 3:
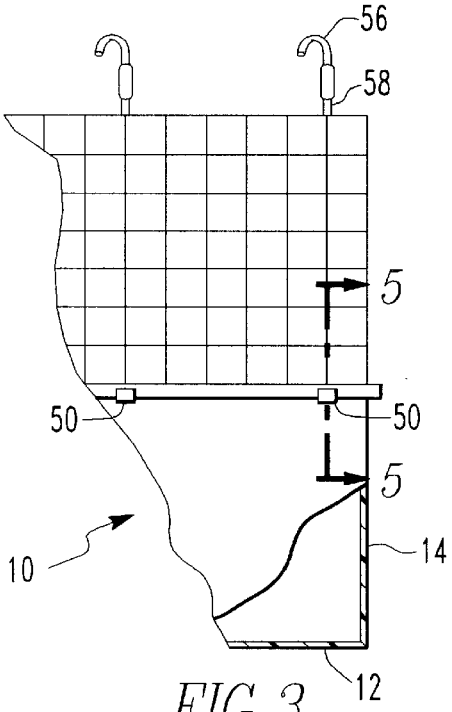
FIG. 3 is a partial rear elevational view of the bin and cover of FIG. 1, except shown partly broken away and in section.
Figure 4:
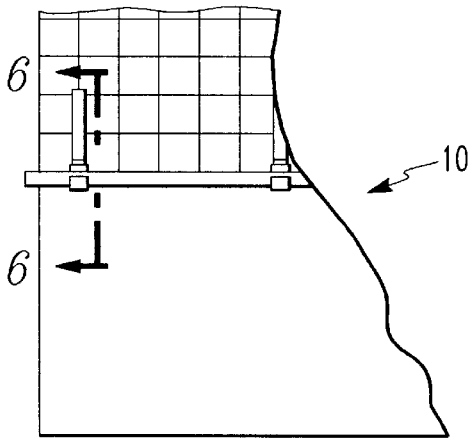
FIG. 4 is a partial front elevational view of the bin and cover of FIG. 2.

A typical recycle container used by salvage companies is illustrated in FIGS. 1–4 and 9, being in the form of an open-top bin 10 having a bottom wall 12 and interconnected sidewalls upstanding therefrom, including opposed end walls 14 and opposed front and rear walls 16 and 18 respectively. The sidewalls at the upper edges are extended outwardly across a narrow peripherial rim 20 and then downwardly as short flanges including front and rear flanges 26 and 28 respectively, thereby adding strength and rigidity and further providing handle or grip areas for picking up and carrying the bin conveniently.

Conventional recycle bins typically are formed of a plastic material to be lightweight, rigid, durable, and resistant against damage from most weather elements. Drain openings (not shown) can be formed in the bottom wall even to minimize water collection in the bin.

Even though bins typically might vary in size and shape from one collection area to another, common bins are possibly 10–20inches wide between the front wall 16 and rear wall 18, between 15–30 inches long between the end walls 14, and 10–20 inches high between the bottom wall 12 and peripherial rim 20. The peripherial rim 20 might be between ½ and 1 inches between a corresponding sidewall and flange, which flange might project downwardly between ½ and 1 inches away from the rim 20. The bin 10 top inside opening 11 thus would be possibly 10 by 15 inches for a small bin and possibly 20 by 30 inches for a large bin; with a larger peripherial rim around the top opening.

In forming this invention, a cover 30 is provided to overlie the top inside opening 11, the rear edge 13 of the cover 30 preferably being fixedly secured relative to the rear bin sidewall 18, and the front edge 36 of the cover 30 being easily and removably connected relative to the front bin sidewall 16.

The cover 30 is dimensionally fixed in size, from edge to edge, preferably being larger than or at least approximately the same size as the bin top opening 11 when measured between the end walls 14 and front and rear walls 16 and 18, but being significantly larger than the bin top opening 11 when measured between the front and rear walls 16 and 18. The cover 30 is flexible laterally to allow it to be rolled on itself, particularly on axes parallel to its front edge 36, or to be bowed up between the opposed front and rear edges 36 and 38 as secured relative to the bin sidewalls 14, 16, and 18; and/or between the opposed end edges 17 and 19. This allows easy and effective containment of items in the bin 10 and loading and unloading of the bin 10 during its expected use.

The cover 30 preferably is formed of a durable plastic, such as a HDPE polyethlene with U.V. stablizer, as a mono-oriented thin laminar open mesh sheet having a continuous perpherial edge band, including front edge band 36, rear edge band 38, and narrow end edge bands 17 and 19 extended therebetween. Further, the cover mesh includes cross webs 42 and 44 respectively generally parallel to the front and rear edge bands 36, 38, and to the end edge bands17, 19; defining thereby a plurality of openings 46. Each cover opening 46 might be possibly ¼–5 inches across, sufficiently small to retain the smallest of items being recycled. Cover openings 46 possibly 1 by 2 inches are specifically adequate, for example, to retain items as small as crushed pop cans(not shown), quite commonly the smallest item routinely collected from recycling residential customers. The thickness of the cover sheet might be between 0.01–0.1 inches, and the widths of the edge bands 36, 38; and webs might be between 0.1–1.0 inches.

Figure 5:
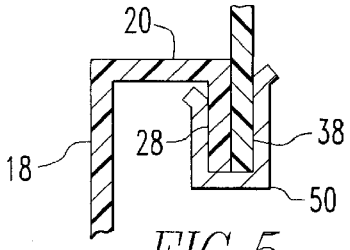
FIG. 5 is an enlarged sectional view taken generally from line 5—5 in FIG. 3, illustrating a preferred manner of securing the cover and bin together.
Figure 5A:
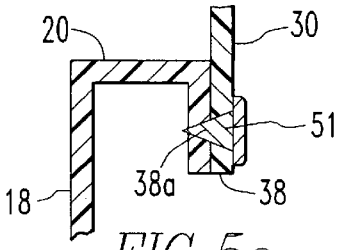
FIG. 5*a* is an enlarged sectional view taken from line 5—5 in FIG. 3, illusrtrating an alternative embodiment of the invention of FIG. 5.

A preferred means for fixedly securing the cover 30 and bin 10 together is by spring C-clips 50, sized to be pressed over and to hold the adjacent overlapping rear bin flange 28 and rear cover edge band 38 tightly together, as illustrated in FIG. 5. To provide an overall fixed connection between the cover 30 and bin 10 that can withstand the rough handling a salvage bin typically will be subjected to, three or more clips 50 typically might be used, the adjacent clips being spaced apart along the edge 38 by perhaps 5–15inches. The C-clips 50 will preferably have inwardly pointed barbs (not shown) for increased holding efficiency.

The C-clips 50 allow a bin user to purchase the cover 30 and easily secure it with minimal tools (not shown) and mechanical skills to an existing bin, making it an attractive add-on bin accessory. As shown in FIG 5 *a*,Other means can be used to fixedly secure the cover 30 and bin 10 together, such as rivets 51 extended through aligned openings 38 *a* drilled or otherwise formed in the lapped bin flange 28 and cover edge band 38, similar to the illustration of FIG. 5. Barbed plastic push-in rivets would be a preferred form. Nonetheless, this alternative with the aligned openings needs more tools to implement than the clips 50, so that its appeal might be limited more to a distributor of a bin and cover combination already connected together as a single unit.

The front edge band 36 of the cover 30 can be releasibly secured relative to the front bin sidewall 16 by means of one or more hooks 56 connected on elastic shock or bunge cords 58, each cord in turn being secured to the cover 30. Each cord 58 will preferably be long enough to present its hook 56, without the cord 58 being stretched, perhaps 1–4 inches beyond the front cover edge 36. An eyelet 60 swaged onto one end of each cord 58 can be attached via a rivet 62 onto the cover 30, but preferably through a hole (not shown) spaced inwardly from the front cover edge 36, as at an intersection point of cross webs 42, 44 spaced possibly several webs in from the front edge band 36.

Cord cover connection at 62 is inwardly spaced from the front cover edge 36 and allows the cord 58 to be between possibly 3–10inches long, expanding the possible cord routing paths and stretch needs, before having the hook 56 secured onto a bin sidewall. An intermediate section of each elastic cord 58 can be loosely coupled to an underlying cross web, as by a clinched ring 64 or by being fed under, over or around adjacent webs through corresponding openings in the cover 30 at one or more of the web intersections between the rivet 51 and cover edge. This will more closely hold the hook 56 relative to the front cover edge 36, while the stretch of a longer cord will work effectively with different bin sizes and degrees of bin loading.

Figure 6:
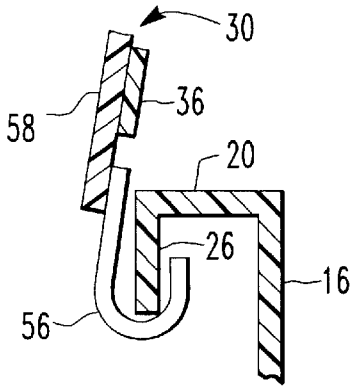
FIG. 6 is an enlarged sectional view taken generally from line 6—6 in FIG. 4, illustrating a preferred manner of releasibly hooking the cover closed over the bin top.
Figure 7:
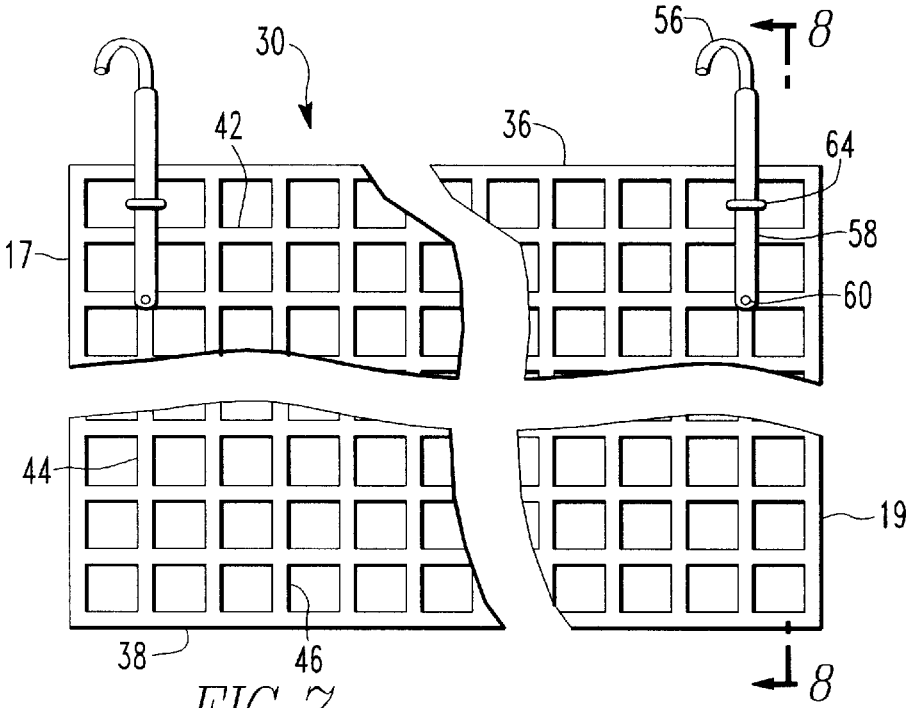
FIG. 7 is an enlarged plan view of a preferred embodiment of cover, showing the corner edges thereof but with intermediate portions broken away.
Figure 8:
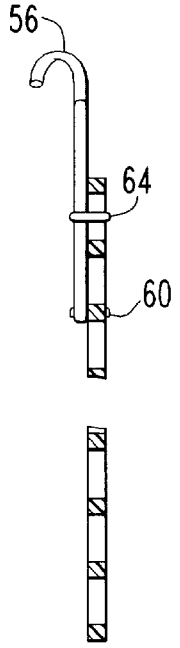
FIG. 8 is a sectional view taken generally from line 8—8 in FIG. 7, illustrating a preferred manner of securing the cover and cover hook together.
Figure 9:
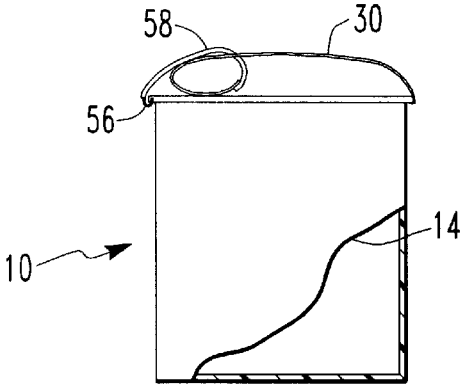
FIG. 9 is an end elevational view similar to FIG. 2, except showing the cover rolled on itself and hooked closed over a partially loaded bin.

For example, the cover 30 can be rolled on itself to reduce its overall front-to-rear effective size to correspond to a bin top, and then can be drawn over and across a bin top and held closed and in place by feeding the stretch cord(s) 58 through adjacent cover opening(s) 46 and then connecting the hook (s) 56 onto the front bin flange 26 (see FIG. 6, 9). Alternatively, the same cover when unrolled to its maximum size, can be bowed up and over items (not shown) contained in the bin 10 but protruding above or beyond the bin top 11, as in an overloaded bin, and held tightly closed by the stretch cords 58 and hooks 56 over the bin top opening 11 with a gap between the cover edge band yet reasonably close to the front bin sidewall 16 for effectively retaining the contained items (not shown) in the bin 10.

The mesh perforated cover provides visibility of the contained items (not shown) for added safety for anyone unloading the bin 10.

While the disclosure of the present invention has emphasised fixedly securing the bin 10 and rear cover edge 38 together, an alternative arrangement might be to use elastic cords 58 and hooks 56 adjacent both the front and rear cover edge bands 36 and 38, suited for having the cover 30 quickly and releasibly connected to both the front and rear bin sidewalls 16, 18, again, for example, at flanges 26, 28. Such hooks 56 could be connected onto elastic stretch cords 58. Further, spring C-clips 50 could be fixedly secured onto the rear edge band 38 of the cover 30, suited to be snapped onto the exposed rear bin sidewall flange 28 as a tight but yet removable connection between the cover 30 and bin 10, if such were desired. This approach again would add accessory appeal, allowing use of the cover 30 only when needed, such as when the bin 10 is to be loaded with lightweight items (not shown) or on windy days, or when the bin 10 is to be overloaded.

What is claimed is:

1. A bin comprising a bottom and a continuous wall extending upward therefrom to form a receptacle having an opening opposite said bottom, said wall further having a rim extending radially outwardly therearound adjacent to said opening;

a flexible over sized for generally overlying said opening; and fastening me for releasably securing said cover to said rim, wherein said fastening means comprises an elastic stretch cord connected at one end to said cover and at the other end releasably to said rim.

2. The combination as recited in claim 1, wherein said cover is formed from a mesh sheet comprised of a plurality of intersecting cross webs.

3. The combination as recited in claim 1, wherein said fastening means comprises a spring C-clip that, when pressed tightly onto said wall, traps said cover between said rim and said spring C-clip.

4. The combination as recited in claim 1, wherein said cover is formed from a mesh sheet comprised of a plurality of intersecting cross webs.

5. The combination as recited in claim 4, wherein said plurality of intersecting cross webs comprises two intersecting groupings of parallelly disposed cross webs and wherein each cross web of said two intersecting groupings of parallelly disposed cross webs is generally spaced by 1 to 4 inches.

6. The combination as recited in claim 4, wherein said elastic stretch cord connects to one of said plurality of intersecting cross webs at a location spaced inwardly from the outer edges of said cover.

7. A recycle bin, comprising:

a bottom;

a continuous wall extending upwardly from said bottom forming a receptacle having an opening opposite said bottom;

a rim extending radially outwardly around the upper perimeter of said wall proximate to said opening;

a generally flexible cover sized to at least overlay said opening and attached to said rim at a first location wherein said cover is comprised of a plurality of intersecting cross webs;

a cord having a first end secured to said cover, wherein said cord comprises an elastic stretch cord; and a fastener connected to a second end of said cord releasably connected with said rim at a second location whereby said cover may be releasably secured over said opening.

8. The recycle bin as recited in claim 7, wherein said rim further comprises a downwardly extending flange.

9. The recycle bin as recited in claim 8, wherein said elastic stretch cord is secured to one of said plurality of intersecting cross webs at a location spaced inwardly from the outer edges of said cover.

10. The recycle bin as recited in claim 9, further comprising a push rivet for use in attaching said cover to said rim at said first location.

11. The recycle bin as recited in claim 9, further comprising a spring C-clip for use in attaching said cover to said rim at said first location.

12. A cover for use in covering a recycle bin comprised of a bottom and a continuous wall extending upwardly therefrom to form a receptacle having an opening opposite said bottom; said cover comprising:

a plurality of intersecting cross webs sized to at least overlay said opening and to attach to said wall at a first location;

a cord having a first end secured to one of said plurality of intersecting cross webs at a location inset from the outer edges of said cover; and a fastener connected to a second end of said cord releasably connected with said wall at a second location for allowing said top cover to be releasably secured to said recycle bin.

13. The cover as recited in claim 12, wherein said plurality of intersecting cross webs comprises two intersecting groupings of parallelly disposed cross webs and wherein each cross web of said two intersecting groupings of parallelly disposed cross webs is generally spaced by 1 to 4 inches.

* * * * *